US008753476B2

(12) United States Patent
Sabourin

(10) Patent No.: US 8,753,476 B2
(45) Date of Patent: Jun. 17, 2014

(54) METHODS FOR PRODUCING HIGH-FREENESS PULP

(75) Inventor: Marc Sabourin, Beavercreek, OH (US)

(73) Assignee: Andritz Technology and Asset Management GmbH, Graz (AT)

( * ) Notice: Subject to any disclaimer, the term of this patent is extended or adjusted under 35 U.S.C. 154(b) by 78 days.

(21) Appl. No.: 13/239,756

(22) Filed: Sep. 22, 2011

(65) Prior Publication Data

US 2012/0085505 A1 Apr. 12, 2012

Related U.S. Application Data

(60) Provisional application No. 61/390,310, filed on Oct. 6, 2010.

(51) Int. Cl.
*D21B 1/12* (2006.01)
*D21B 1/26* (2006.01)

(52) U.S. Cl.
USPC ..... 162/24; 162/23; 162/25; 162/26

(58) Field of Classification Search
CPC ..... D21B 1/26; D21B 1/12; D21B 1/16
USPC ..... 162/23, 24, 25, 26
See application file for complete search history.

(56) References Cited

U.S. PATENT DOCUMENTS 5,879,510 A 3/1999 Hägglund et al.
6,899,791 B2 5/2005 Sabourin
7,758,720 B2 7/2010 Sabourin

FOREIGN PATENT DOCUMENTS

WO WO 00/50688 8/2000

OTHER PUBLICATIONS

Smook, Handbook for Pulp and Paper Technologists, 1992, Angus Wilde Publications, 2nd edition, chapters 5 and 11.*
Göran Annergren, et al., "Continuous Prehydrolysis-Kraft Cooking," Tappi, vol. 48, No. 7, Jul. 1965, pp. 52 A-56 A.
International Search Report issued for PCT Application No. PCT/US2011/053811, dated Jan. 27, 2012.
International Preliminary Report on Patentability issued for PCT/US2011/053811, dated Apr. 29, 2013.

* cited by examiner

*Primary Examiner* — Anthony Calandra
(74) *Attorney, Agent, or Firm* — Nixon & Vanderhye PC

(57) ABSTRACT

Methods of producing mechanical pulps from lignocellulosic material including partial defibration of lignocellulosic material in a chip press followed by liquid impregnation, preheating the lignocellulosic material for 20 seconds or less at a pressure between 7.5 and 12 bar (gauge) prior to mechanically refining the lignocellulosic material in a primary mechanical refiner at a pressure between 7.5 and 12 bar (gauge), thus obtaining a high freeness pulp.

20 Claims, 15 Drawing Sheets

Figure 2: [Specific Energy at 600 ml] versus Presteam Retention Time
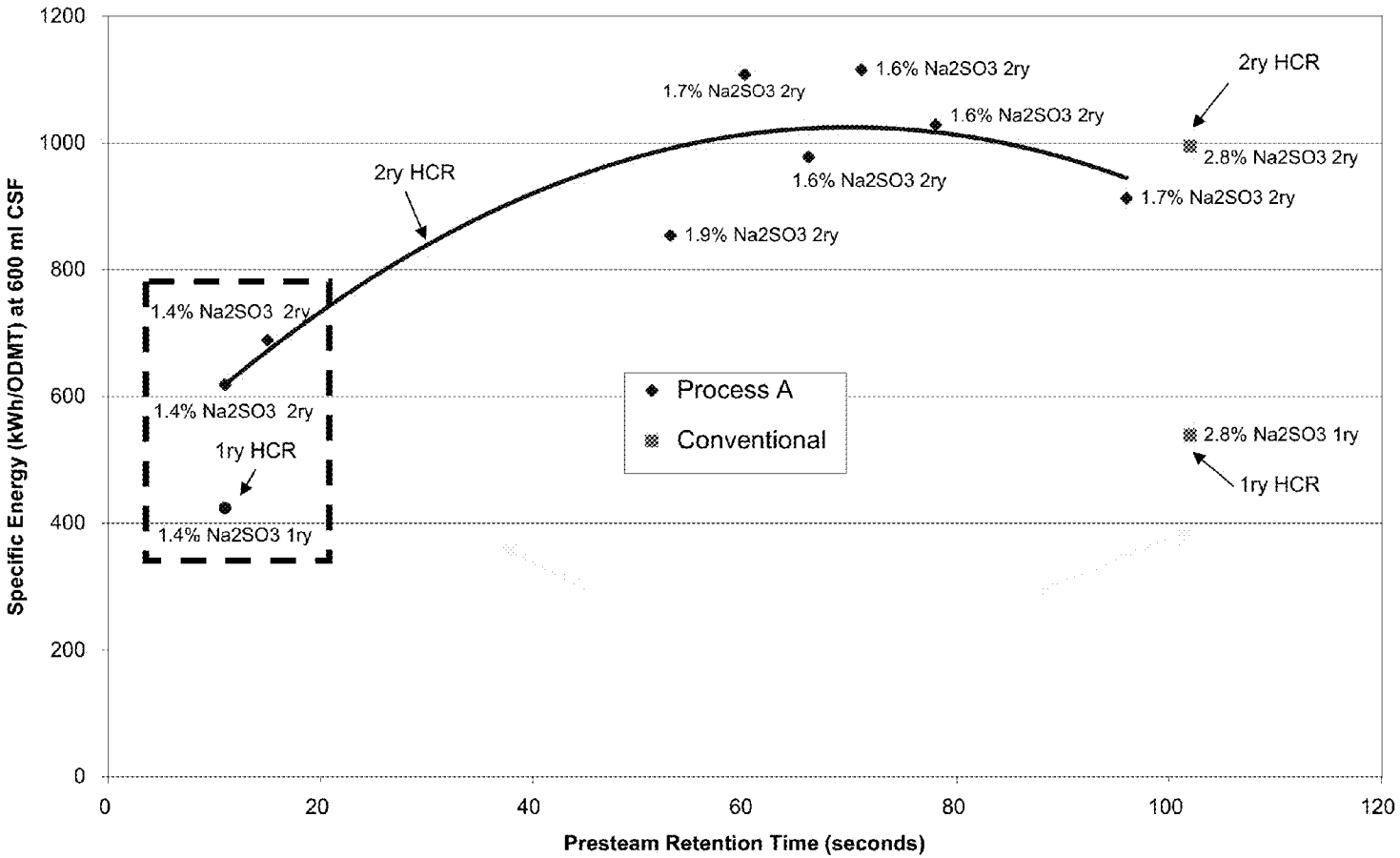

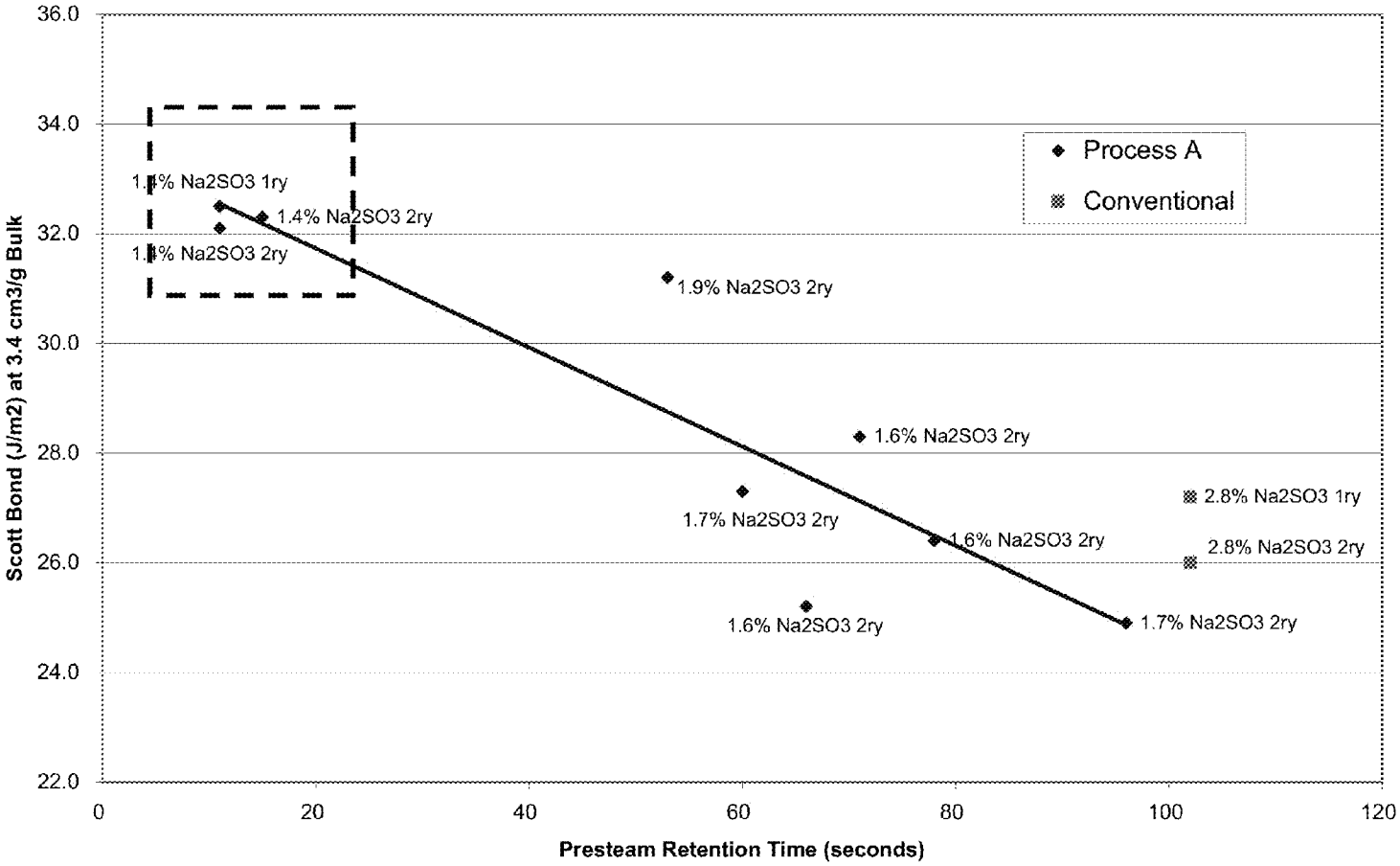
Figure 3: [Scott Bond at 3.4 cm3/g Bulk] versus Presteam Retention Time Figure 4: [Brightness at 600 ml] versus Presteam Retention Time
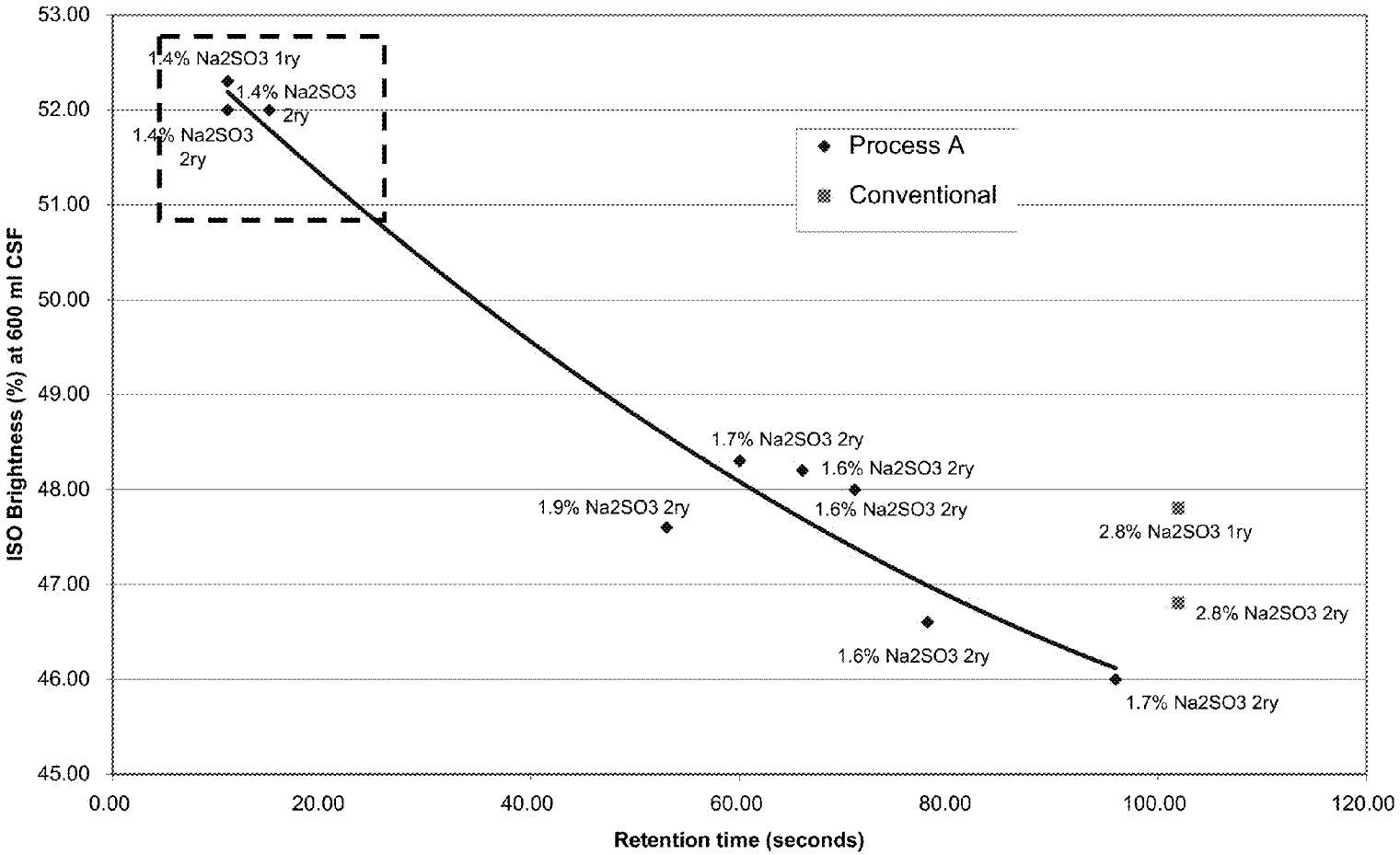

Figure 5: [Scattering coefficient at 600 ml] versus Presteam Retention Time
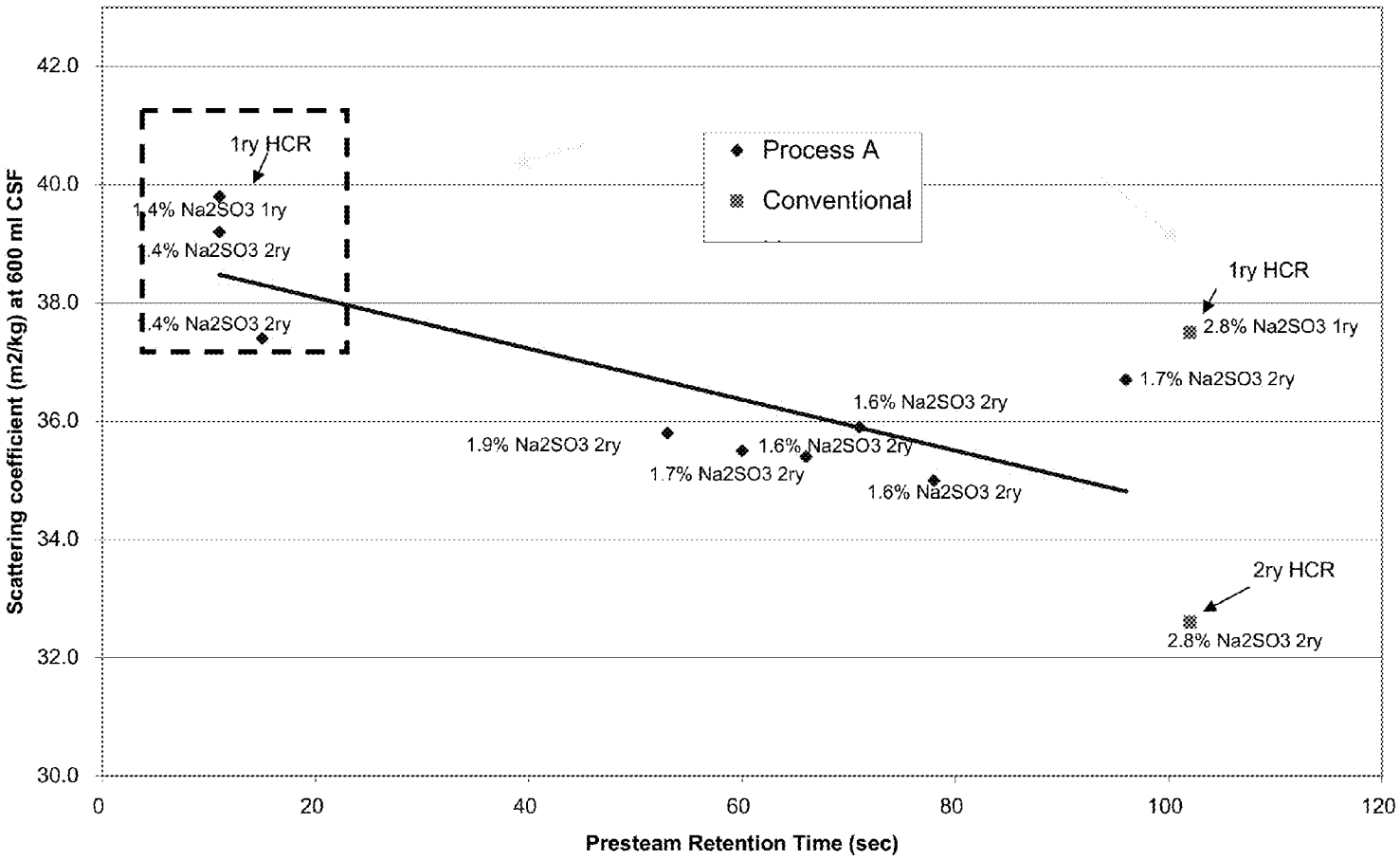

Figure 6: [R14 Mesh at 600 ml] versus Presteam Retention Time
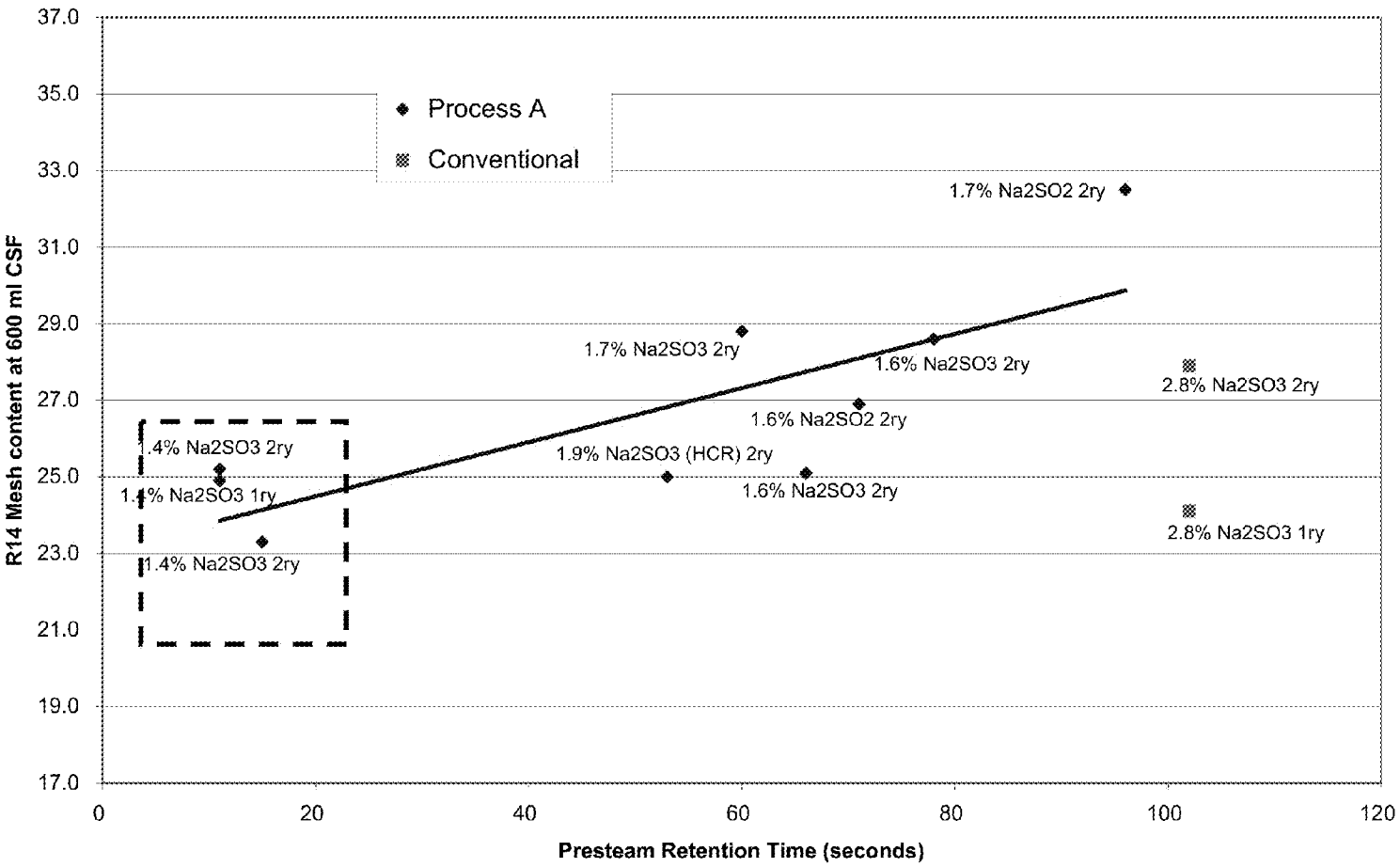

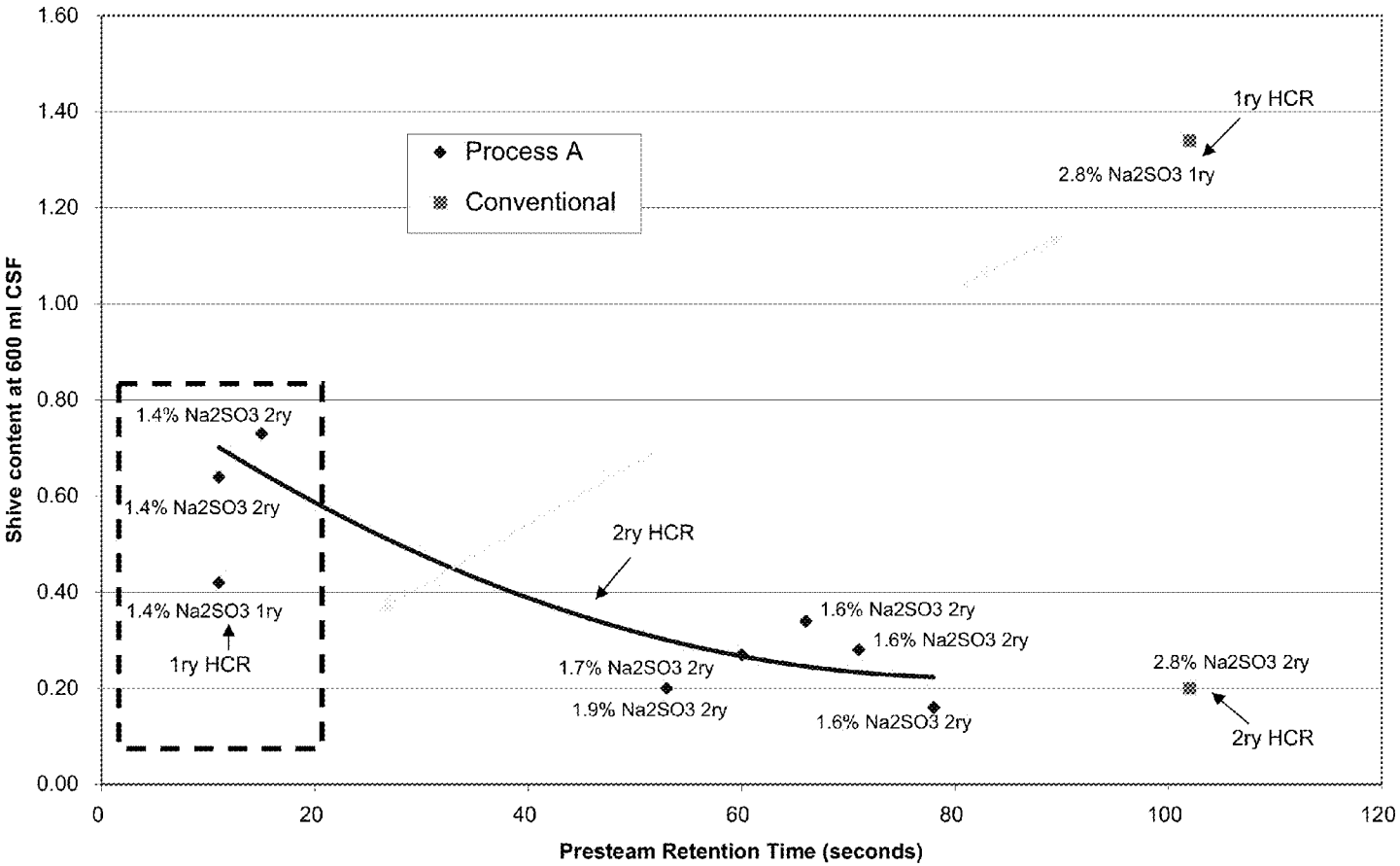
Figure 7: [Shive content at 600 ml] versus Presteam Retention Time

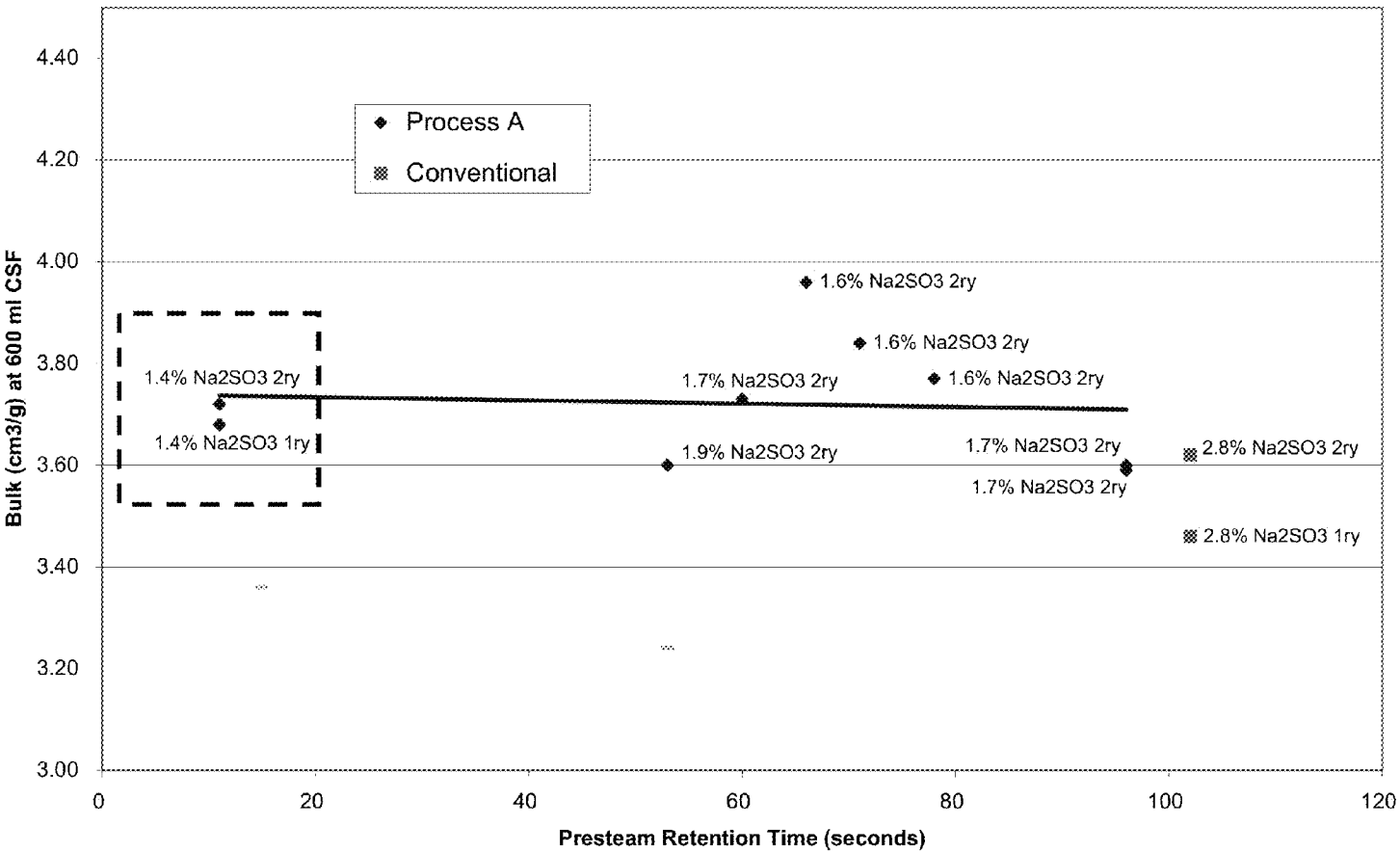
Figure 8: [Bulk at 600 ml] versus Presteam Retention Time
Norway Spruce
Process A
Conventional
1.4% Na2SO3 2ry
1.4% Na2SO3 1ry
1.6% Na2SO3 2ry
1.6% Na2SO3 2ry
1.6% Na2SO3 2ry
1.7% Na2SO3 2ry
1.9% Na2SO3 2ry
1.7% Na2SO3 2ry
1.7% Na2SO3 2ry
2.8% Na2SO3 2ry
2.8% Na2SO3 1ry
Bulk (cm3/g) at 600 ml CSF
4.40
4.20
4.00
3.80
3.60
3.40
3.20
3.00
Presteam Retention Time (seconds)
0
20
40
60
80
100
120

Figure 9: [+28 Mesh content at 600 ml] versus Presteam Retention Time
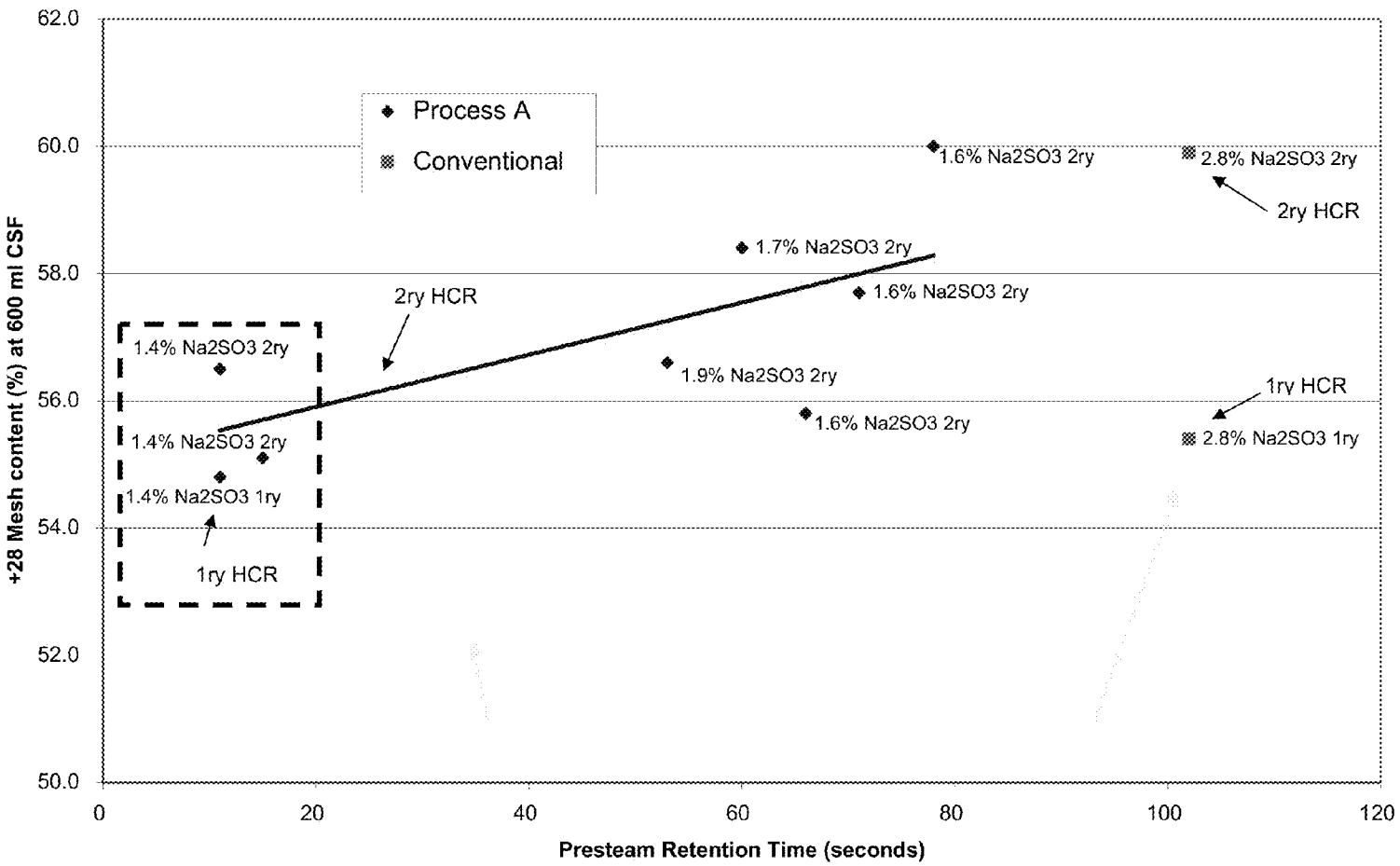

Figure 10: Tensile index of R14 + R28 Fraction
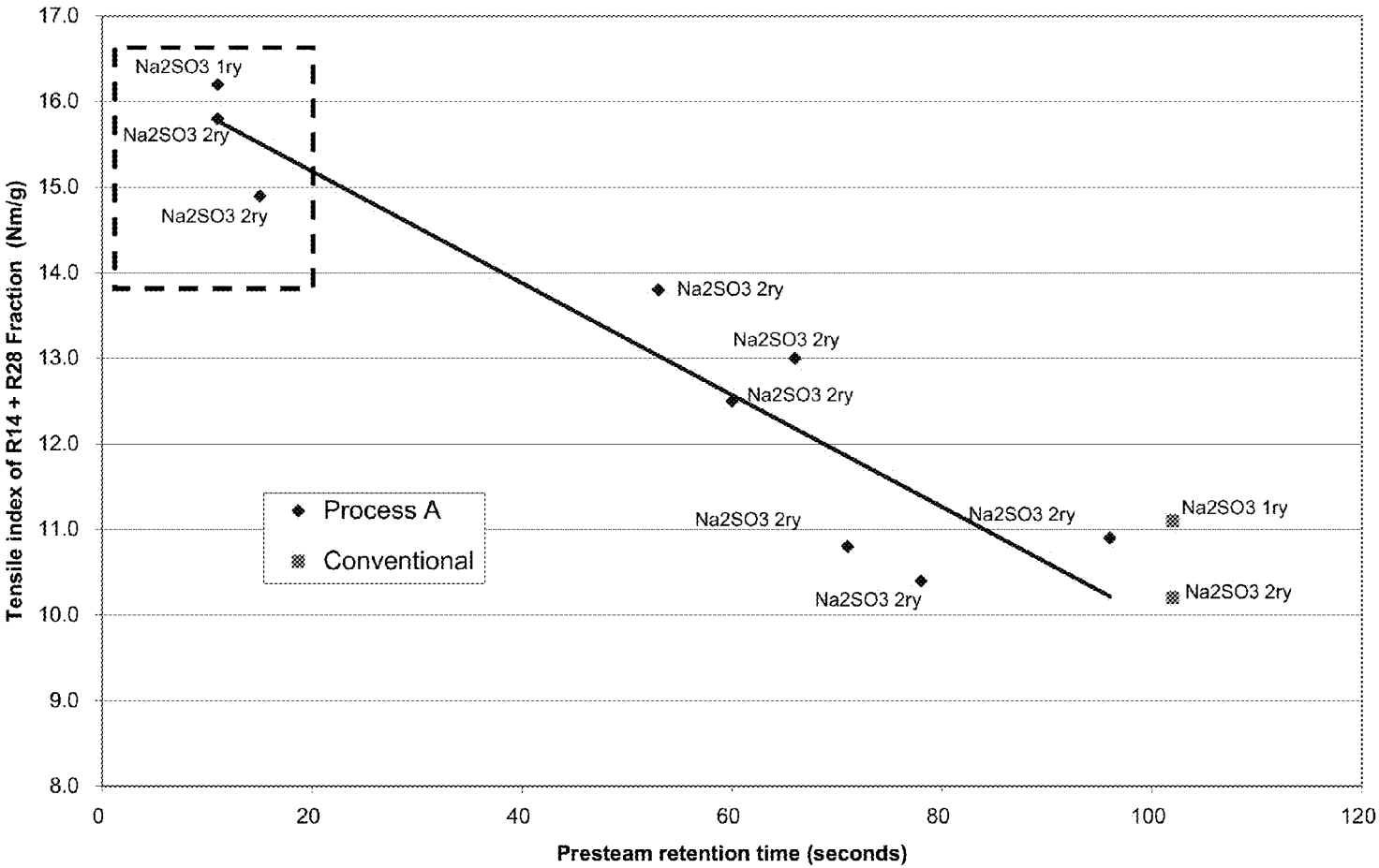

Figure 11: [Scott Bond at 600 ml] versus [R14 content at 600 ml]
Norway Spruce
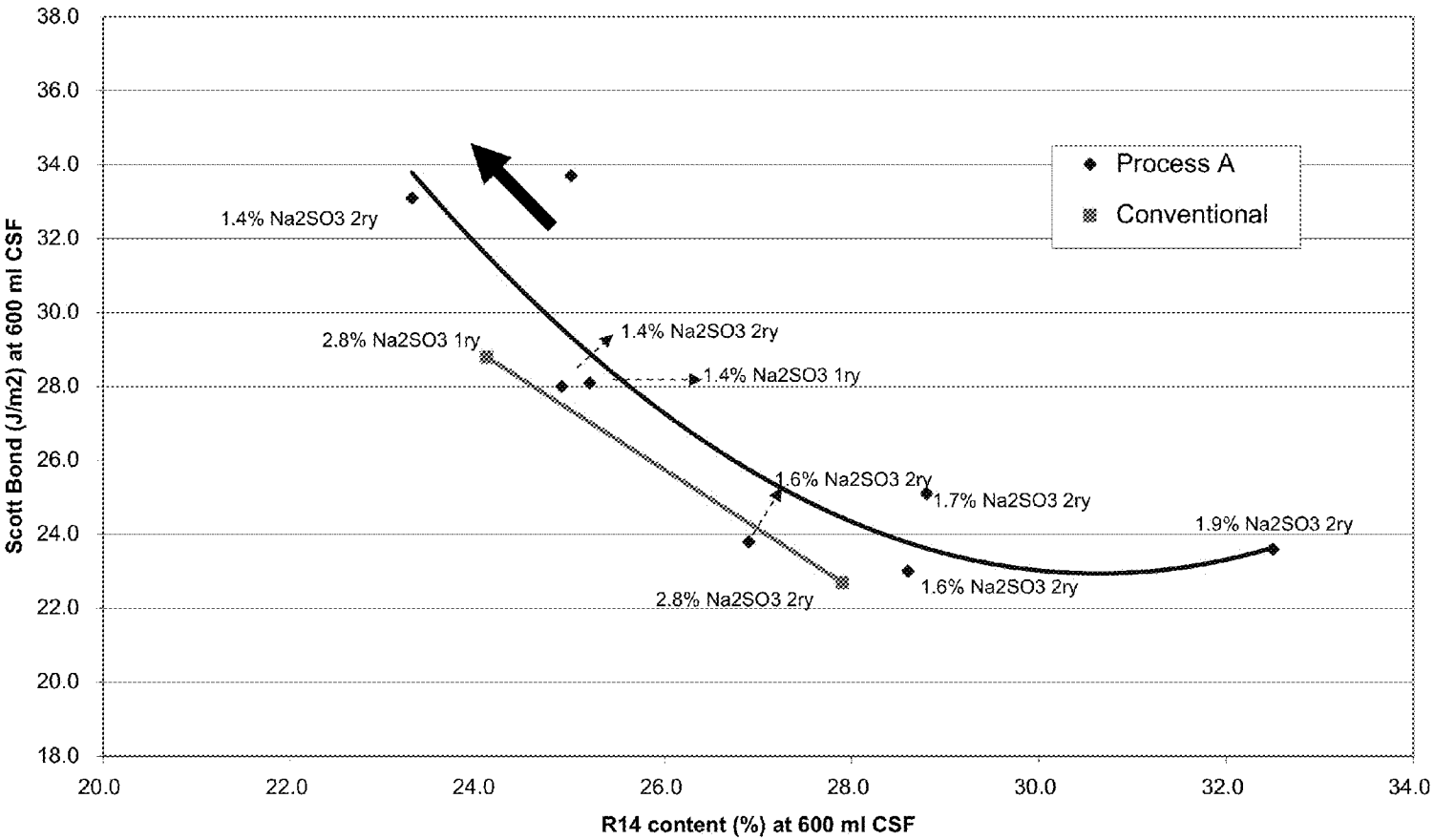

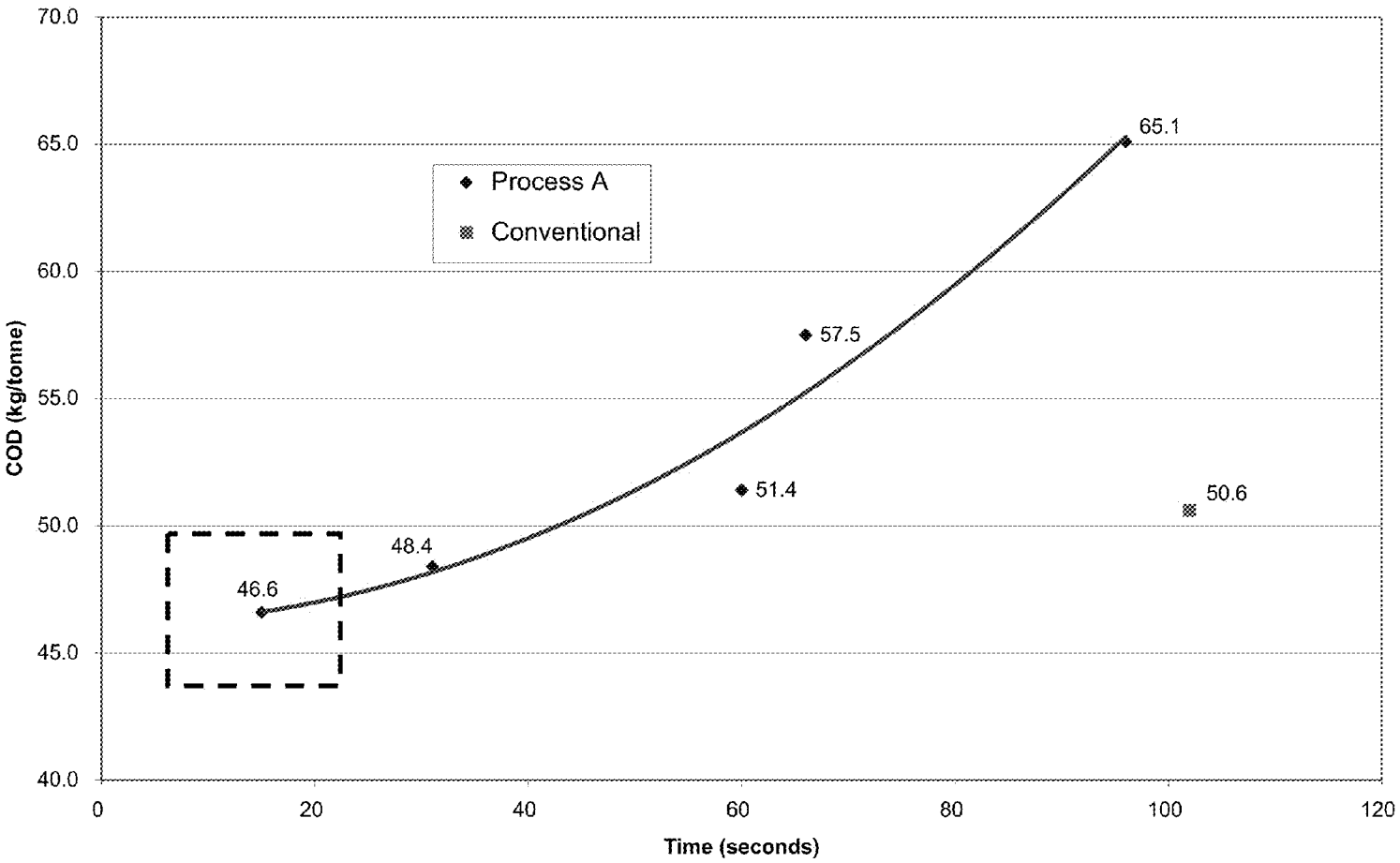
Figure 12: Chemical Oxygen Demand (kg/tonne)

Figure 13: Bleached Brightness
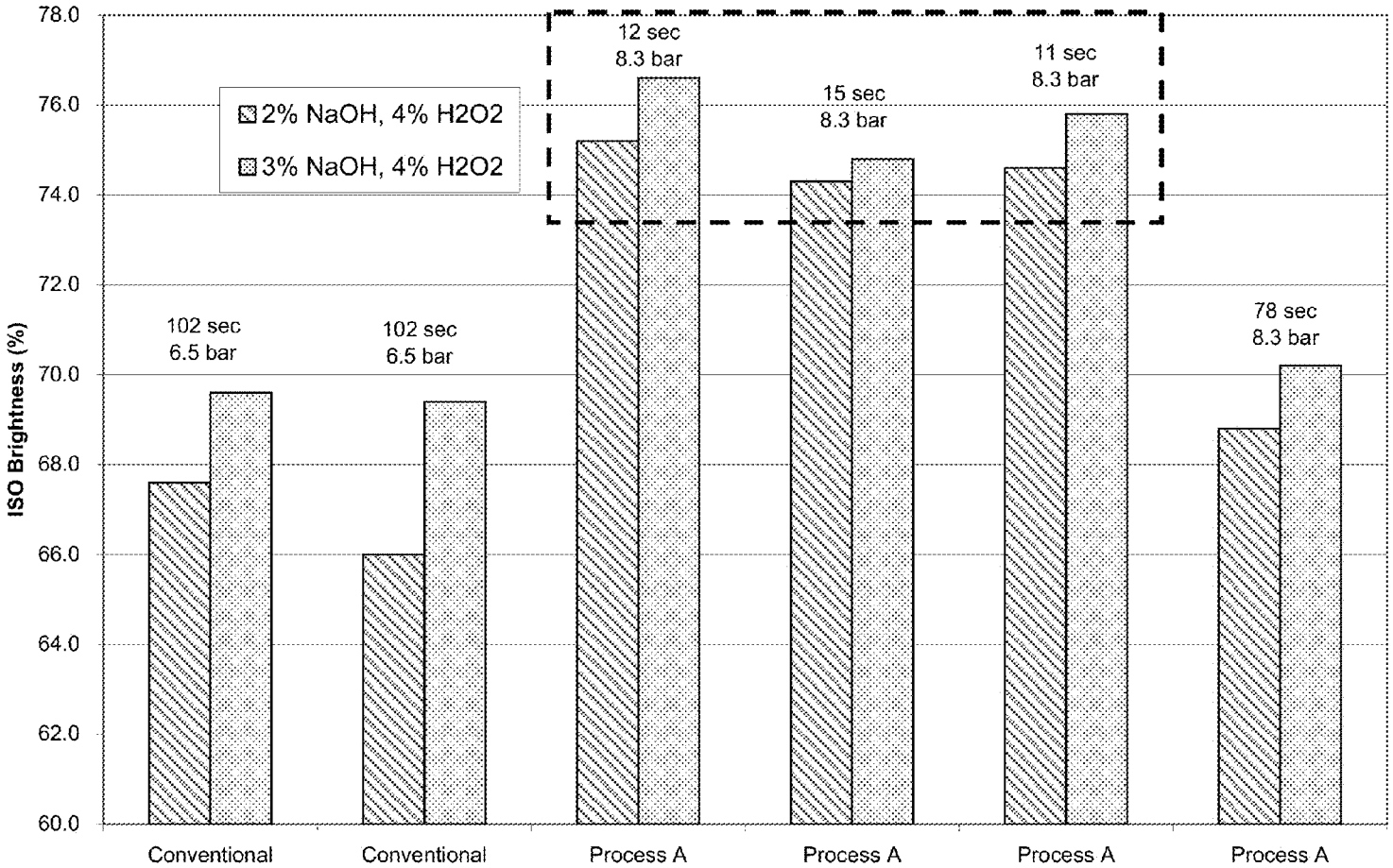

Figure 14: Brightness Gain
Norway Spruce
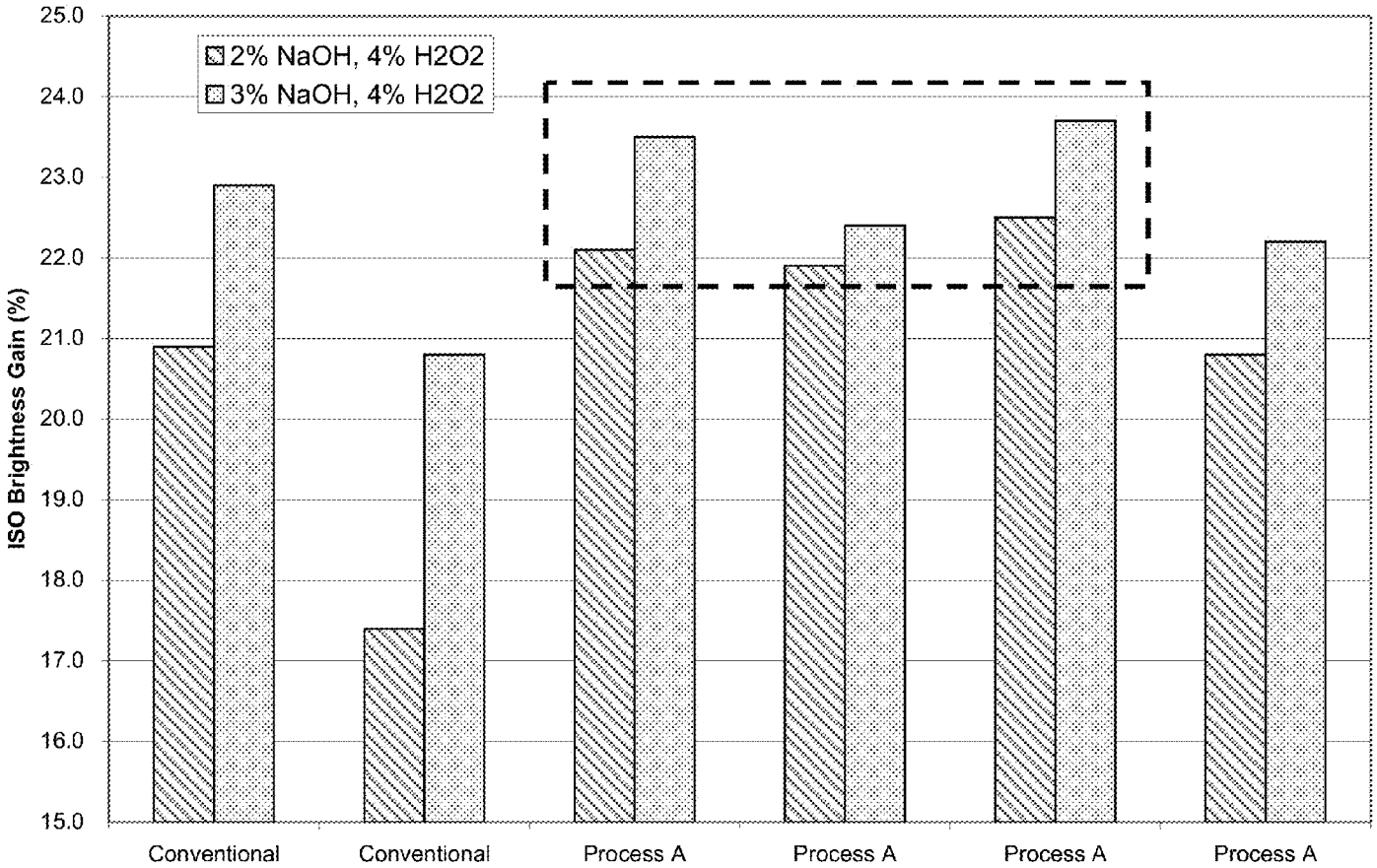

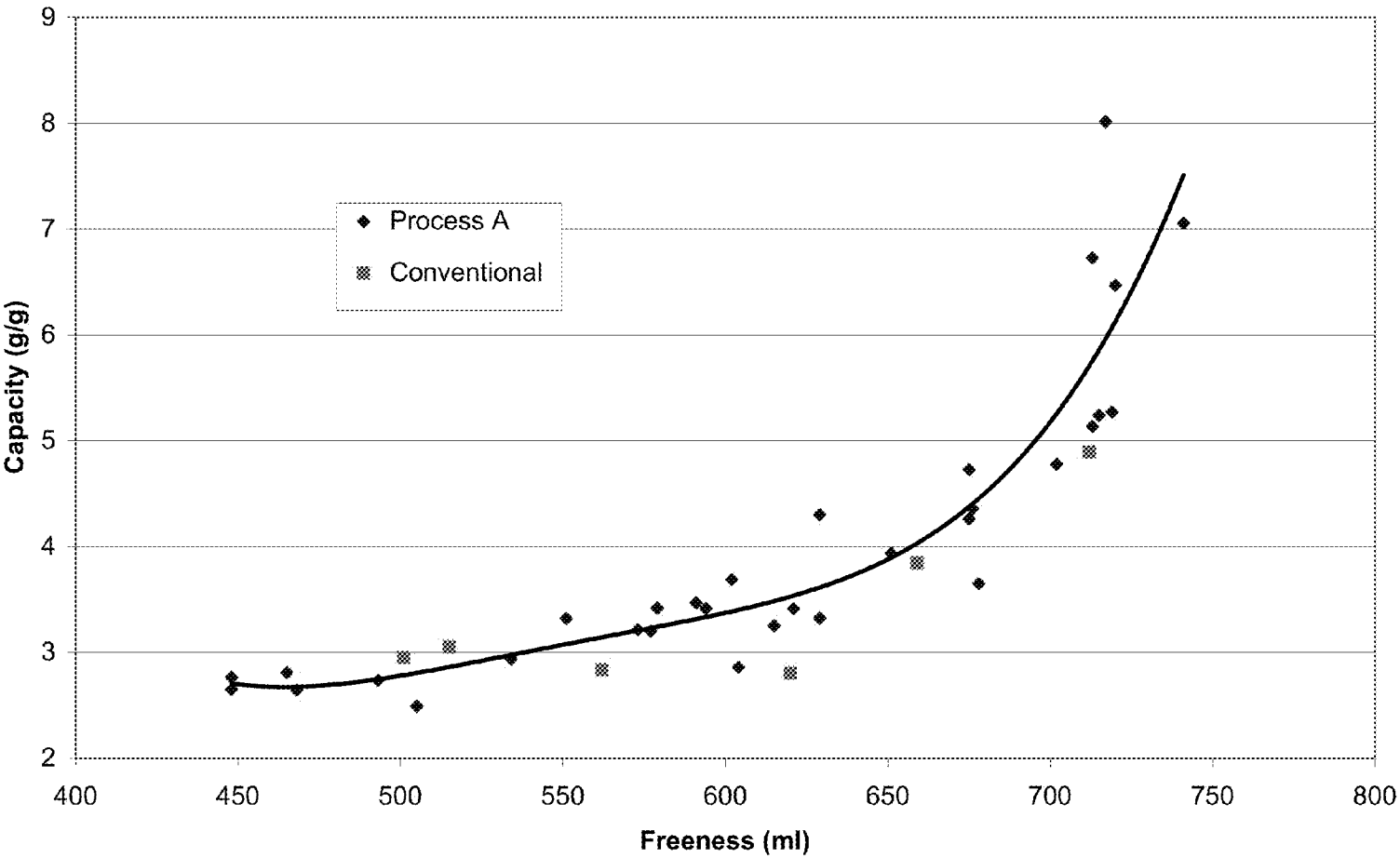
Figure 15: CSF vs Absorption Capacity

METHODS FOR PRODUCING HIGH-FREENESS PULP

This application claims the benefit of priority to U.S. App. No. 61/390,310, filed Oct. 6, 2010, the entire contents of which are incorporated herein by reference.

BACKGROUND OF THE INVENTION

In an aspect, the present invention generally relates to producing a high freeness pulp from lignocellulosic feed material via mechanical and/or chemi-mechanical refining techniques that may be suitable for paperboard and absorbency grade applications.

Techniques for mechanical and chemi-mechanical refining are known. For example, U.S. Pat. No. 7,758,720 describes a mechanical or chemi-mechanical refining system that includes three major subsystems: preprocessing, pretreatment, and production or primary refining.

The '720 patent describes a conventional preprocessing subsystem, such that a feed material comprising wood chips is washed then maintained in a pre-streaming bin or the like at atmospheric conditions for a period of time typically in the range of 10 minutes to 1 hour before being conveyed to the pretreatment subsystem.

The '720 patent further describes a pretreatment subsystem that includes a pressurized rotary valve for maintaining pressure separation between the preprocessing subsystem and the balance of the pretreatment subsystem, a pressurized compression device (such as a screw press), a decompression zone or decompression region (which may be part of the screw press or connected to the discharge of the screw press), and a fiberizing device (such as a disc or conical refiner).

As described in the '720 patent, the environment within the compression device, the decompression zone, and the fiberizer are all maintained at a saturated steam atmosphere in the range of about 5-30 psig (i.e., 0.3-2.1 bar). The '720 patent describes a transfer screw interposed between the pressurized rotary valve and the compression device, whereby the time period during which the chips in the transfer screw are exposed to the saturated steam pressure and temperature conditions, before entering the screw press, can be controlled. As a minimum, the '720 patent teaches that chips should be conditioned for a period of 5 seconds in a saturated steam atmosphere at 5 psig pressure.

The principle application for pulps produced using the method of the '720 patent were for mechanical printing paper applications including newsprint and magazine grades; such pulps are typically produced at lower freeness, less than 150 ml, and require significant energy application. An important goal of the '720 patent was to lower the energy consumption of energy intensive mechanical printing grade pulps.

It is understood in the art that high preheating and refining temperatures, well above the lignin softening temperature, are preferred in order to produce high freeness mechanical pulp from wood chips with low shive content. Such pulps are well suited for paperboard middle ply applications and are preferably refined at pressure levels in the range of 90 psig or higher; well above that used to produce mechanical pulps for printing paper applications. A drawback of these higher pressure pulps is lower pulp brightness. A chemi-thermomechanical pulping technique utilizing such high temperatures for high freeness pulp is disclosed, e.g., in U.S. Pat. No. 5,879,510.

It is believed that the prior art for producing higher freeness mechanical pulps, while achieving acceptable properties such as low shive content and good inter-ply strength, may be deficient in other aspects including long fiber content (too high), long fiber bonding (too low), inter-ply surface strength at a given bulk (too low), unbleached and bleached pulp brightness (too low). Incremental gains in surface strength without a sacrifice (reduction) in pulp bulk is an extremely important attribute for enhancing the competitiveness of paperboard middle layer pulps.

BRIEF DESCRIPTION OF THE INVENTION

In an aspect, an embodiment relates to preheating destructured wood chips in an environment of saturated steam at a saturation gauge pressure in the range of 7.5 bar-12.0 bar (173° C.-192° C.) for a period of 20 seconds or less during which period the feed material is conveyed toward and introduced into the refiner. According to an embodiment, the feed material may be refined under pressure in the primary refining step with the disc rotating at a speed of at least 2000 rpm, preferably refining to a freeness in a range between 300 ml to 600 ml.

BRIEF DESCRIPTION OF THE DRAWINGS

FIG. 2 is a graph illustrating specific energy versus presteam retention time at a constant freeness.

FIG. 3 is a graph illustrating Scott Bond versus presteam retention time at a constant bulk.

FIG. 4 is a graph illustrating brightness versus presteam retention time at a constant freeness.

FIG. 5 is a graph illustrating scattering content versus presteam retention time at a constant freeness.

FIG. 6 is a graph illustrating R14 mesh content versus presteam retention time at a constant freeness.

FIG. 7 is a graph illustrating skive content versus presteam retention time at a constant freeness.

FIG. 8 is a graph illustrating bulk versus presteam retention time at a constant freeness.

FIG. 9 is a graph illustrating +28 mesh content versus presteam retention time at a constant freeness.

FIG. 10 is a graph illustrating tensile index of R14 and R28 mesh content versus presteam retention time.

FIG. 11 is a graph illustrating Scott Bond versus R14 mesh content at a constant freeness.

FIG. 12 is a graph illustrating chemical oxygen demand versus presteam retention time.

FIG. 13 is a chart illustrating bleached brightness for exemplary embodiments of the present invention and comparative examples.

FIG. 14 is a chart illustrating brightness gain for exemplary embodiments of the present invention and comparative examples.

FIG. 15 is a chart illustrating absorption capacity versus pulp freeness for exemplary embodiments of the present invention and comparative examples.

DETAILED DESCRIPTION OF THE INVENTION

Figure 1:
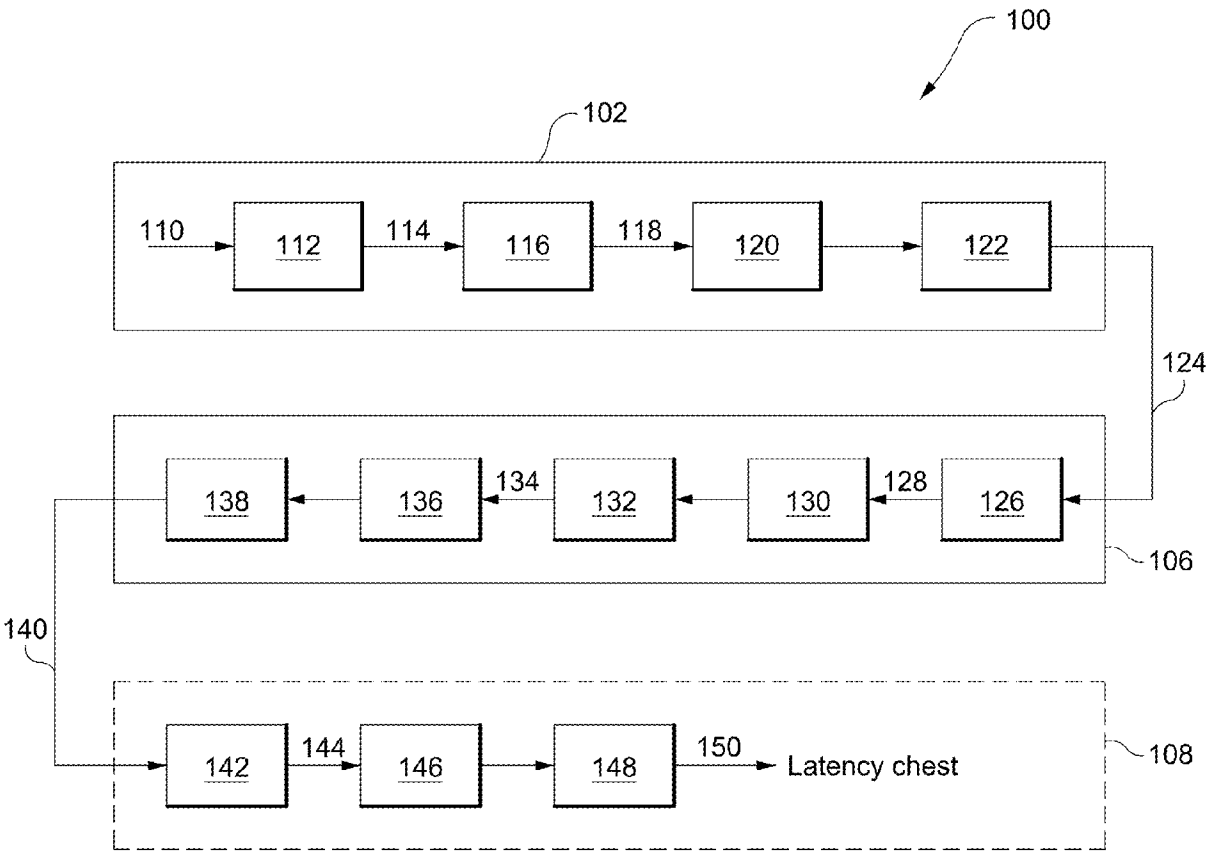
FIG. 1 is an illustration of an exemplary process in accordance with an aspect of the present invention.

In an aspect, the present invention generally relates to a method for producing pulp from lignocellulosic fiber material (e.g., wood chips or other material) by a mechanical pulping process which includes the steps of chip destructuring and optionally chemical impregnation, rapid high temperature preheating of the optionally impregnated material in an environment of saturated steam and at least a primary refining step performed by a disc refiner.

In an aspect, an embodiment relates to destructuring wood chips in an environment of saturated steam at high compression, such that over 65% of the destructured chips by weight passes through a 16 mm screen perforation, then preheating the destructured material by maintaining the fiber material at least 50° C. above the glass transition temperature of the lignin at a saturation gauge pressure in the range of 7.5 bar-12.0 bar (173° C.-192° C.) for a period of 20 seconds or less during which period the feed material is conveyed toward and introduced into the refiner without mechanical compression. According to this embodiment, the feed material is immediately refined under pressure in the primary refining step with the disc rotating at a speed of at least 2000 rpm, preferably refining to a freeness in a range between 300 ml to 600 ml.

In alternative embodiments, over 50% of the destructured chips by weight pass through a 16 mm screen perforation. In yet other embodiments, over 80% or over 90% of the destructured chips by weight pass through a 16 mm screen perforation.

A smaller size distribution following the destructuring step enhances the thermal diffusivity of steam and increases the uniformity and rate of heating. Preferably destructured chips retained on a 25 mm screen perforation should be less than 1% and chips retained on a 19 mm perforation should be preferably less than 5%.

An aspect is that the wood chips are destructured under pressurized conditions such that the structural integrity of the lignocellulosic fibers may be preserved and partial defibration can occur along the radial grain of the fibers.

FIG. 1 illustrates an exemplary process 100 in accordance with an embodiment of the present invention. Process 100 includes pretreatment subsystem 102 and production or primary refining subsystem 106. Process 100 optionally includes a secondary refining subsystem 108 which may include secondary refining as depicted or medium or low consistency pump-through refining. Low consistency refining is in the range of 3%-5% consistency and medium consistency refining is in the range of 5%-12% consistency.

As illustrated, pretreatment subsystem 102 includes feeding lignocellulosic material (e.g., wood chips or other woody material) via line 110 to a plug screw feeder 112 (or other suitable device operating with or without the aid of gravity, such as a pump or chip chute). In alternate embodiments, plug screw feeder could be replaced or exchanged with a rotary valve, a modular screw feeder, or other pressure separated feeding device capable of separating an inlet with different pressure than an outlet (e.g., atmospheric inlet and pressurized outlet). From the plug screw feeder 112 or other feeding device, the lignocellulosic material travels to a high compression device 120 via a variable speed pressurized conveyer 116 via lines 114 and 118. The high compression device 120 may be a modular screw device, e.g., a MSD or high compression plug screw feeder (PSF), that assists in reducing variations in the lignocellulosic material and may provide a more uniform size distribution. The high compression device 120 may include chemical additions at the discharge such that the lignocellulosic material entering vertical impregnator 122 may be optionally at least partially mixed with chemicals useful in chemi-mechanical pulping (e.g., sodium sulfite, sodium bisulfite, sodium hydrosulfite, alkaline peroxide liquors, and other chemical agents or water). In certain applications liquid impregnation may be conducted using fresh water or white water with or without addition of further chemical agents. Thus, as used in this application the term "a chemical useful in chemi-mechanical pulping" can include one or more of the above chemical agents, water, or white water. The impregnator may be vertical or inclined or simply a chamber with a suitable discharge device in alternative embodiments.

Pretreatment subsystem 102 may operate at a pressure of 0.3 to 1.4 bar (gauge) or 0.1 to 3.0 bar (gauge), such that it is slightly pressurized. There may be a pressure of 0.3 to 3 bar (gauge) at the screw inlet, and there may be a 5 to 20 second retention time between the plug screw feeder and the chip plug in the chip compression device. In accordance with an embodiment of the present invention, the pretreatment subsystem may be one as described, e.g., in U.S. Pat. No. 6,899,791, the entirety of which is incorporated herein by reference.

Within preprocessing subsystem 102, the lignocellulosic material (optionally with chemicals added at discharge of chip compression device 120) enter the impregnator 122, where the impregnation of lignocellulosic material with chemicals may further occur. From impregnator 122, the lignocellulosic material travels via line 124 to plug screw feeder 126. In some embodiments, there may be an atmospheric presteam bin between impregnator 122 and plug screw feeder 126. In the pretreatment subsystem 102, the impregnator 122, presteam chip bin (if any), and the plug screw feeder 126 may operate under atmospheric pressure. In another embodiment a pressurized impregnator may be used with a direct feed via pressurized conveyor 130 to the pressurized primary refiner 132; such an application may eliminate the need for a plug screw feeder 126. In alternate embodiments, plug screw feeder 126 could be replaced or exchanged with a rotary valve, a modular screw feeder, or other pressure separated feeding device capable of separating an inlet with different pressure than an outlet (e.g., atmospheric inlet and pressurized outlet).

From the pretreatment subsystem 102, the lignocellulosic material is fed via line 128 to a variable speed pressurized conveyor 130 in production or primary refining subsystem 106. In certain embodiments, the residence time for the lignocellulosic material in the variable speed pressurized conveyor 130 may be 20 seconds or less. From the variable speed pressurized conveyor 130, the lignocellulosic material is then transferred to a primary mechanical refiner 132. In another embodiment where absolute minimum retention time is desired the pressurized transfer conveyor 130 may be omitted from the subsystem. The primary mechanical refiner 132 preferably operates at a rate of rotation of 2000 rpm or greater. Furthermore, the primary refining subsystem 106 preferably operates at a pressure of 7.5 to 12 bar (gauge) (i.e., 108 to 174 psig).

In some embodiments, it may be possible for the primary mechanical refiner to operate at greater than 2100 rpm, greater than 2200 rpm, greater than 2500 rpm, and so forth up to the operational limit of the particularly selected mechanical refiner. In another embodiment the refiner may operate at standard disc speeds of 1500 rpm (50 Hz AC) or 1800 rpm (60 Hz AC); in such an application the use of more aggressive high intensity refiner plates may be desired and advantageous to obtain reductions in energy consumption during the refining step.

In some embodiments, it may be possible to operate the primary refining subsystem at a pressure greater than 12 bar. Such applications may be suitable when the retention time between the feeding device 126 and primary refiner 132 is at an absolute minimum i.e. less than 3 seconds.

The combination of very high pressure (>7.5 bar) and short retention time between the feeding device 126 and primary refiner 132 provides benefits not taught or suggested by prior art systems. A thermomechanical pulping technique is disclosed using elevated pressure and low retention conditions e.g. U.S. Pat. No. 5,776,305. But this technique achieved low freeness pulps for printing paper applications using a pressure range between 75 to 95 psig (5.2 to 6.5 bar), well below that recommended for high freeness pulps using the current method, i.e. >7.5 bar.

From primary mechanical refiner 132, the refined lignocellulosic material may be sent to a latency chest (not shown) via lines 138 and 140 and fiber centrifuge 136 for steam separation, and optionally a plug screw feeder 138. Some installations may use an alternative steam separation device such as a pressurized cyclone instead of a centrifuge. Alternatively, the refined lignocellulosic material may be entirely or partially sent to an optional secondary refining subsystem 108, which contains a high consistency secondary refiner 142, lines 144 and 150 as well as fiber centrifuge 146 and optionally a plug screw feeder 148. The secondary refiner 142 may operate at a disc rotation rate less than that of the primary refiner, e.g., at a conventional disc rotation rate of 1500 rpm or 1800 rpm. Secondary refining may instead be conducted at low or medium consistency. In the case of low or medium consistency refining the primary refined pulp discharges into a tank and is diluted between 3% to 10% consistency prior to pump feeding the secondary refiner.

In an aspect, an embodiment of the present invention may generally relate to destructuring and compressing wood chips using a screw press in an environment of saturated steam. A desired inlet pressure of the chip compression device may be in the range of 0.7 to 3 bar (gauge) (i.e., 10 to 44 psig). There may be impregnation of the destructured wood chips at the press discharge with a chemical solution in an impregnator. The chemical solution used for impregnation may include sodium sulfite, sodium bisulfite, sodium hydrosulfite, alkaline peroxide liquors and other chemical agents. The alkali base in alkaline peroxide liquors may include (but are not limited to) sodium hydroxide, magnesium hydroxide, magnesium carbonate, sodium carbonate and others. In further embodiments, water or white water in the TMP system could be used in the impregnator.

In an aspect, there may be rapid preheating of the destructured wood chips for a period of less than 20 seconds in an environment of saturated steam in the range of 7.5 bar to 12 bar, corresponding to temperatures in the range of 173° C. to 192° C. The preheating in the environment of saturated steam may occur for a period of time less than 15 seconds or less than 12 seconds.

Immediately following the preheating under high pressure, there may be refining of the preheated wood chips in a high consistency refiner operating at a disc rotational speed greater than (or equal to) 2000 rpm and in a common environment of saturated steam in the range of 7.5 bar to 12 bar. Another embodiment may entail refining below 2000 rpm using preferentially high intensity refiner plates.

An example of an embodiment of the present invention was prepared.

Norway spruce wood chips were produced into mechanical pulp as follows. The wood chips were first preheated in an environment of saturated steam for 15 seconds at a pressure of 1.4 bar (20 psig) and immediately compressed and destructured in a common steam environment (1.4 bar) in a pressurized screw press. The destructured chips were then impregnated in an inclined impregnator with a solution of sodium sulfite adjusted to a pH level of 7. The impregnated chips were quickly preheated in a saturated steam environment of 8.3 bar (120 psig) for a period of 11-15 seconds and then immediately primary refined in a common steam environment (8.3 bar) using a 91 cm diameter single disc refiner operating at a disc speed of 2100 rpm. Multiple levels of specific energy were applied in the primary refining step. Secondary refining at multiple levels of specific energy application was also conducted for evaluation and comparison to the primary refined pulps.

Additional refiner series were also produced at higher levels of presteam retention time for comparison. In generating these examples and comparative examples, changes in pulp quality, long fiber bonding, specific energy consumption, COD and bleachability at low versus higher levels of presteam retention time were observed.

The nomenclature used for the aforementioned refiner series produced at lower and higher retention times is "Process A". Referring to the figures it is noted that the low retention series produced according to the inventive method are illustrated with a dashed rectangle surrounding the data.

As mentioned, a series was also produced using prior art, conventional methods, including atmospheric chip compression (instead of pressurized) followed by sulfite impregnation at a similar application and pH, preheating at 6.5 bar (95 psi) for a longer period (102 seconds), followed by high consistency refining at 6.5 bar and disc speed of 2100 rpm. The nomenclature used for this comparative example is "Conventional".

In an aspect, an embodiment of the present invention may, for example, improve thermal diffusivity of wood chips by way of destructuring such that the wood structure is more size reduced and has more exposed surface area, thereby improving the rate of fiber heating when subjected to a rapid heat treatment at elevated temperature. The wood structure may be quickly softened to the desired degree, rendering the wood fibers more amenable to energy-efficient high intensity refining. In the current example, the destructured wood chips from Process A had the following size distribution by weight: 0.59% on 25 mm, 3.95% on 19 mm, 10.87% on 16 mm, 16.21% on 13 mm, 46.64% on 6 mm, 16.01% on 3 mm, and 5.73% passing through a 3 mm hole screen plate.

FIG. 2 presents the specific energy consumption for each of the refiner series interpolated to a freeness of 600 ml versus presteam retention time. Each data point on the figure was interpolated from best fit regressions to a freeness of 600 ml.

"Freeness" as used herein refers to how quickly water is drained from the pulp. "CSF" refers to Canadian Standard Freeness, as is well understood in the art. Freeness can reflect the degree of refining or beating.

Referring to FIG. 2, it is clear that a decrease in the presteam retention time resulted in a decrease in the specific energy consumption to a given freeness. It appears that a retention level of 11-15 seconds resulted in the lowest specific energy consumption.

As shown in FIG. 2, single-stage refining (1ry) had lower energy consumption to a given freeness than did two-stage refining (2ry); this observation was apparent for both Process A and Conventional pulps. The primary refined pulp from Process A had the lowest energy consumption to a given freeness; 424 kWh/ODMT to a freeness of 600 ml.

FIG. 3 presents the Scott Bond for each of the refiner series interpolated to a bulk of 3.4 $cm^3/g$ versus presteam retention time. Scott Bond is an important surface strength property for paperboard middle layer pulp and is a direct measurement of the ability of the middle ply pulp layer(s) to bond with the outer layers during paperboard formation. For example, it refers to internal bond test that measures the force needed to separate fibers within a single ply.

A high Scott Bond at a given bulk is particularly desirable to paperboard producers. A significant increase in Scott Bond was observed at a given bulk for the Process A pulps produced at lower presteam retention time. Bulk refers to the inverse of density.

From FIG. 3, it was also observed the primary refined pulps had at least as good Scott Bond values compared to the secondary refined pulps, indicating that applying the energy in a single stage refiner was more efficient than distributing the energy application across two stages of refining.

The Process A pulps produced at low presteam retention time had significantly higher Scott Bond than the Conventional pulps. The results indicate higher pressure (e.g., 8.3 bar) and lower presteam retention (e.g., 11-15 seconds) conditions are more desirable for Scott Bond development than a lower pressure and longer presteam retention.

In some embodiments, Scott Bond may be improved by at least 1 $J/m^2$ (e.g., 2+ or 5+1 $J/m^2$) when compared to prior art processes (e.g., Conventional pulps described herein) or comparative processes having longer pretreatment retention times than 20 seconds.

FIG. 4 presents unbleached pulp brightness for each of the refiner series interpolated to a freeness of 600 ml versus presteam retention time. The pulp brightness of the pulps produced according to embodiments of the present invention (Process A) clearly increased at the lower retention time levels; a direct result likely from fewer thermal darkening reactions.

The brightness of pulp from Process A at low retention time (e.g., 11-15 seconds) was at least 4% ISO higher than the brightness of the Conventional pulps, despite the higher presteam pressure of Process A. The results appear to indicate "heat-shocking" the destructured and impregnated wood and high speed refining successfully obtained a combination of higher surface strength and higher brightness.

It is believed that the "heat-shocked" fibers may have less time for the lignin to liquefy and coat the fibers, thereby resulting in more exposed fiber wall material for surface bonding. This explanation is supported by an increase in scattering coefficient at lower presteam retention time (see FIG. 5). An increase in scattering coefficient most probably arises from increased fiber surface material available for scattering light. Other explanations are plausible but it is well understood in the literature that a reduction in the heating reduces the flow and surface coating of lignin on fibers.

The R14 fraction (as defined by the Bauer-McNett classification mesh) generally contains the longest, coarsest and least developed fibers. This fiber fraction has the lowest bonding strength (tensile index) and surface strength (Scott Bond) properties. FIG. 6 presents the R14 Mesh content for each of the refiner series interpolated to a freeness of 600 ml versus presteam retention time. The Process A pulps produced at low presteam retention time had a lower R14 content, which likely contributed to the higher Scott Bond results observed at low presteam retention time. Accordingly, a preferred embodiment of the present invention refines pulp in a single stage to freeness levels below 600 ml for maximum surface development at minimum energy consumption.

FIG. 7 presents the shive content (unscreened) of each refiner series interpolated to a freeness of 600 ml versus presteam retention time. A 0.10 mm screen plate was used in the shive analyzer. Low shive content is generally a requirement for most high freeness pulps used for paperboard middle layer and absorbency grades. All of the pulps produced using Process A had a low unscreened shive content. The pulps produced at the lowest retention levels had somewhat higher shive content than pulps produced at higher presteam retention time; however overall shive levels were quite favorable for a 600 ml pulp. It is noted the single-stage refined pulp from Process A had lower shive content than the two-stage refined pulps. The primary refined Process A pulp had a 0.42% unscreened shive content at a freeness of 600 ml, desirable for paperboard and absorbency application.

FIG. 8 shows that presteam retention time in accordance with embodiments of the present invention does not affect bulk at a constant freeness.

FIG. 9 presents the +28 mesh content (R14+R28) for each of the refiner series interpolated to a freeness of 600 ml versus presteam retention time. The +28 Mesh content decreased with a reduction in the presteam retention time. The +28 Mesh fraction appears to demonstrate an inverse correlation with Scott Bond. The primary refined pulp produced at low presteam retention time had the lowest +28 Mesh content and conversely the highest Scott Bond.

The bonding ability of the long fiber +28 mesh fraction can be an important property for assessing surface quality when middle ply layers are over and under layed with other ply layers. Tensile index is most commonly used to assess pulp bonding. FIG. 10 presents the tensile index of the +28 mesh (R14 and R28 fractions combined) versus presteam retention time. From FIG. 10 it is apparent that the bonding ability of the long fibers improved at low presteam retention. This observation helps explain the higher Scott Bond values obtained at low retention time.

FIG. 11 shows Scott Bond as a function of R14 mesh content at a constant freeness. Refining to a lower R14 content improved the Scott Bond for both Process A and Conventional pulps. A notable aspect of the present invention as aforementioned is that a reduction in the presteam retention time has a favorable consequence on +14 content (lower) and resultant improvement in Scott Bond.

FIG. 12 presents the chemical oxygen demand (COD) for several Process A and Conventional refiner series. COD reflects the amount of oxygen consumed in oxidation. The COD content of the Process A series clearly decreased with a decrease in presteam retention time, from 65.1 kg/tonne at 96 seconds retention down to 46.6 kg/tonne at 15 seconds retention. The Process A pulp produced at low retention times also had a lower COD content than the Conventional pulp. The results indicate a lesser generation of organic substances at lower presteaming times which in turn reduces the cost for effluent treatment.

The examples and evidence relating thereof, it is evident that a number of advantages are apparent using embodiments of the present invention for improving the competitiveness of paperboard and absorbency grades. A low retention time in the range of 11-15 seconds appears to be optimal for minimizing electricity demand and chemical costs associated with specific energy consumption and pulp bleaching, respectively. Several important pulp properties were enhanced using the proposed method including surface bonding strength, long fiber quality and brightness.

Several pulps were bleached on the bench scale using an alkaline peroxide liquor to evaluate the impact of presteam retention time on bleached brightness. The pulps were bleached at a consistency of 30% for two hours at a temperature of 70° C. The pulps were first pretreated with a chelating agent, diethylene triamine pentaacetic acid (DTPA), prior to bleaching. An application of 0.4% DTPA was applied during the pulp pretreatment. The bleach liquor was then mixed into the pulps and sealed in plastic bags prior to bleaching. Two alkaline peroxide formulations were evaluated on each pulp, 4% $H_2O_2$, 2% NaOH and 4% $H_2O_2$, 3% NaOH on pulp (oven dry basis). Each bleach liquor formulation contained stabilizers including 3% sodium silicate, 0.1% DTPA and 0.15% $MgSO_4$ as applied on pulp (oven dry basis).

FIGS. 13 and 14 present the brightness of the bleached pulps and brightness gain for Process A and Conventional versus presteam retention time. The pulp produced using Process A at low retention time (e.g., 11-seconds) had a significantly higher bleached brightness than the respective Process A pulp produced at higher retention times. The Process A pulp also had a significantly higher brightness compared to the Conventional pulp, approx. +8% ISO brightness gain. The difference in final bleached brightness was greater than the difference in unbleached brightness between the low and high presteam retention pulps, indicating an improved bleachability for the pulps produced at low retention time. A reduced level of thermal darkening reactions in the pulp at lower presteam retention levels facilitates the bleaching reaction.

FIG. 15 presents absorption capacity results for primary and secondary refined pulp samples tested from the refiner series produced from both Process A and Conventional techniques. The absorption capacity was strongly influenced by the pulp freeness, the higher the freeness the higher the absorption capacity of water. Both the Process A and Conventional pulps appeared to have a similar absorption capacity at a given pulp freeness. The absorption capacity of the pulps is suitable for fluff pulp, tissue, towel and other absorbency pulp grades.

Single-stage refining to a given freeness was more efficient than two stages of refining for minimizing specific energy consumption. Most pulp properties were similar or enhanced using one stage of high consistency refining instead of two stage refining.

The following table presents pulp properties and specific energy consumption results for the Process A (8.3 bar) and Conventional (6.5 bar) pulps refined using one stage of refining. The pulp properties are interpolated at a freeness of 600 ml.

TABLE

Single stage refined pulp properties and specific energy consumption at 600 ml

| | | Process A at 600 ml | Conventional at 600 ml |
|---|---|---|---|
| Presteam Retention | seconds | 15 | 102 |
| SEC | kWh/ODMT | 424 | 539 |
| Bulk | $cm^3/g$ | 3.68 | 3.46 |
| Shives | % | 0.42 | 1.34 |
| +28 Mesh (R14 + R28) | % | 54.8 | 55.4 |
| COD (before bleaching) | kg/tonne | 46.6 | 50.6 |
| Brightness (before bleaching) | % ISO | 52.3 | 47.8 |
| Brightness (after bleaching)* | % ISO | 76.6 | 69.4 |
| Scott Bond at 3.4 $cm^3/g$ bulk | $J/m^2$ | 32.5 | 27.2 |

*4% $H_2O_2$, 3% NaOH, 3% sodium silicate, 0.15% $MgSO_4$, 0.1% DTPA

The single stage refined pulps produced using Process A at low retention time had lower specific energy consumption and several improved properties for high freeness pulp grades compared to the single stage refined Conventional pulps. The enhanced properties include bulk (higher), skive content (lower), unbleached brightness (higher) and bleached brightness (higher). The Process A pulps had a significantly higher surface strength as measured by Scott Bond when compared at a similar bulk. Middle-ply layer pulp with a high Scott Bond at a given bulk is of particular importance to paperboard producers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of producing a mechanical pulp from lignocellulosic material in a pulping system comprising a pretreatment subsystem comprising a pressure separated feeding device, a high compression device, and an impregnator, and a production subsystem comprising a variable speed pressurized conveyor and a primary mechanical refiner, the method comprising the following steps:

providing lignocellulosic material to the pressure separated feeding device and then transferring the lignocellulosic material to the high compression device; wherein the step of destructuring the lignocellulosic material in the high compression device results in a destructured lignocellulosic material in which over 50% of the destructured lignocellulosic material by weight passes through a 16 mm screen perforation; transferring the lignocellulosic material from the high compression device to the impregnator and impregnating the lignocellulosic material;

transferring the lignocellulosic material to the variable speed pressurized conveyor, wherein a residence time of the lignocellulosic material in the variable speed pressurized conveyor is 20 seconds, and wherein the variable speed pressurized conveyor operates at a pressure between 7.5 and 12 bar (gauge) and preheats the lignocellulosic material with steam;

transferring the lignocellulosic material to the primary mechanical refiner; and mechanically refining the lignocellulosic material in the primary mechanical refiner at a pressure between 7.5 and 12 bar (gauge) to obtain a high freeness pulp.

2. The method of claim 1 further comprising the step of mixing the lignocellulosic material with at least a first chemical useful in chemi-mechanical pulping in the impregnator following the high compression device.

3. The method of claim 2, wherein the first chemical useful in chemi-mechanical pulping is selected from the group consisting of sodium sulfite, sodium bisulfite, sodium hydrosulfite, alkaline peroxide liquors, water, and white water.

4. The method of claim 1, further comprising the step of operating the pretreatment subsystem at a pressure of 0.1 to 3.0 bar (gauge).

5. The method of claim 1, further comprising operating the pretreatment subsystem such that the lignocellulosic material has a retention time of 5 to 20 seconds between the pressure separated feeding device and a chip plug in the high compression device.

6. The method of claim 1, wherein the pretreatment subsystem further comprises an atmospheric presteam bin and a second pressure separated feeding device between the impregnator and variable speed pressurized conveyor.

7. The method of claim 1 further comprising the step of operating the pretreatment subsystem under atmospheric pressure.

8. The method of claim 1 further comprising the step of mechanically refining the lignocellulosic material in the primary mechanical refiner at a speed greater than or equal to 2100 rpm.

9. The method of claim 1 further comprising the step of mechanically refining the lignocellulosic material in the primary mechanical refiner at a speed greater than or equal to 2500 rpm.

10. The method of claim 1 further comprising the step of operating the variable speed pressurized conveyor and the primary mechanical refiner at a pressure of 8.5 to 11 bar (gauge).

11. The method of claim 1, further comprising a step of impregnating the lignocellulosic material with at least a first chemical useful in chemi-mechanical pulping in the impregnator such that the impregnation results in a destructured lignocellulosic material in which over 65% of the destructured lignocellulosic material by weight passes through a 16 mm screen perforation.

12. The method of claim 1, wherein the production subsystem further comprises secondary refiner, the method further comprising the step of mechanically refining the lignocellulosic material in the secondary mechanical refiner downstream of the primary mechanical refiner, wherein the secondary refiner operates at a disc rotation rate lower than that of the primary mechanical refiner.

13. The method of claim 1, wherein the method makes a pulp having a freeness in a range between 300 ml to 600 ml.

14. The method of claim 1, wherein the method makes a fluff pulp, a tissue pulp, a towel pulp, or an absorbency pulp at freeness levels between 400 ml to 700 ml.

15. The method of claim 1, wherein the method makes a pulp suitable for paperboard.

16. The method of claim 1, wherein the method makes a pulp having a higher Scott Bond at a constant bulk than a comparative pulp made by a method in which the variable speed pressurized conveyor has a residence time of 100 seconds and operates at a pressure of 6.5 bar (gauge).

17. The method of claim 1, wherein the method makes a pulp having a lower skives content at a freeness of 600 ml than a comparative pulp made by a method in which the retention time between the feed screw and primary refiner has a residence time of 100 seconds and operates at a pressure of 6.5 bar (gauge).

18. The method of claim 1, wherein the method makes a pulp having a higher brightness than a comparative pulp made by a method in which the variable speed pressurized conveyor has a residence time of 100 seconds and operates at a pressure of 6.5 bar (gauge).

19. A method of producing a mechanical pulp from lignocellulosic material in a pulping system comprising a pretreatment subsystem comprising a pressure separated feeding device, a high compression device, and an impregnator, and a production subsystem comprising a variable speed pressurized conveyor and a primary mechanical refiner, the method comprising the following steps:

providing lignocellulosic material to the pressure separated feeding device and then transferring the lignocellulosic material to the high compression device; wherein the step of destructuring the lignocellulosic material in the high compression device results in a destructured lignocellulosic material in which over 50% of the destructured lignocellulosic material by weight passes through a 16 mm screen perforation;

transferring the lignocellulosic material from the high compression device to the impregnator and impregnating the lignocellulosic material;

transferring the lignocellulosic material to the variable speed pressurized conveyor, wherein a residence time of the lignocellulosic material in the variable speed pressurized conveyor is 20 seconds, and wherein the variable speed pressurized conveyor operates at a pressure between 7.5 and 12 bar (gauge) and preheats the lignocellulosic material with steam;

transferring the lignocellulosic material to the primary mechanical refiner; and mechanically refining the lignocellulosic material in the primary mechanical refiner at a speed greater than or equal to 2000 rpm and at a pressure between 7.5 and 12 bar (gauge) to obtain a high freeness pulp.

20. The method of claim 19, wherein the step of impregnating the lignocellulosic material in the impregnator is performed with a chemical useful in chemi-mechanical pulping selected from the group consisting of sodium sulfite, sodium bisulfite, sodium hydrosulfite, alkaline peroxide liquors, water, and white water.

* * * * *